US010320137B2

(12) United States Patent
Almouli

(10) Patent No.: US 10,320,137 B2
(45) Date of Patent: Jun. 11, 2019

(54) CONTINUOUSLY ROTATABLE PLUG

(71) Applicant: Alon Almouli, Tel Aviv (IL)

(72) Inventor: Alon Almouli, Tel Aviv (IL)

(73) Assignee: Alon Almouli, Tel Aviv (IL)

( * ) Notice: Subject to any disclaimer, the term of this patent is extended or adjusted under 35 U.S.C. 154(b) by 0 days.

(21) Appl. No.: 16/068,120

(22) PCT Filed: Jan. 8, 2017

(86) PCT No.: PCT/IL2017/050022
§ 371 (c)(1),
(2) Date: Jul. 4, 2018

(87) PCT Pub. No.: WO2017/118988
PCT Pub. Date: Jul. 13, 2017

(65) Prior Publication Data

US 2019/0013634 A1 Jan. 10, 2019

Related U.S. Application Data

(60) Provisional application No. 62/275,315, filed on Jan. 6, 2016.

(51) Int. Cl.
*H01R 39/64* (2006.01)
*H01R 35/02* (2006.01)
*H01R 35/04* (2006.01)

(52) U.S. Cl.
CPC ..... *H01R 39/64* (2013.01); *H01R 35/02* (2013.01); *H01R 35/04* (2013.01)

(58) Field of Classification Search
CPC ..... H01R 39/60; H01R 39/62; H01R 39/64; H01R 35/04
USPC ..... 439/13, 18, 20, 21, 22, 23, 24, 25, 26, 439/27, 28, 30
See application file for complete search history.

(56) References Cited

U.S. PATENT DOCUMENTS 4,037,901 A * 7/1977 Kaszuba ..... H01R 13/4532 439/138
5,399,093 A * 3/1995 Schneider ..... H01R 24/28 439/21
5,484,299 A * 1/1996 Schlessinger ..... H01R 13/4532 200/51.1
5,795,168 A * 8/1998 Duhe ..... H01R 13/652 200/51.09
5,967,815 A * 10/1999 Schlessinger ..... H01R 29/00 200/51.09
6,015,307 A * 1/2000 Chiu ..... H01R 13/71 200/51.09
6,079,995 A * 6/2000 Duhe, Jr. ..... H01R 13/652 200/51.09
6,196,851 B1 * 3/2001 Gerard ..... H01R 35/04 439/20
6,302,743 B1 * 10/2001 Chiu ..... H01R 25/003 439/22

(Continued)

*Primary Examiner* — Ross N Gushi
(74) *Attorney, Agent, or Firm* — The IP Law Firm of Guy Levi, LLC

(57) ABSTRACT

The disclosure relates to a 360°, continuously rotatble (swiveling) electric plug adaptor or socket. Specifically, the disclosure relates to a rotatble plug or socket comprising a toroidal component configured to maintain continuous, 360° conductive contact between a plugged male connector and a power source.

10 Claims, 6 Drawing Sheets

(56) References Cited

U.S. PATENT DOCUMENTS 6,332,794 B1 * 12/2001 Tzeng Jeng ..... H01R 35/04 439/13
6,638,074 B1 * 10/2003 Fisher ..... H01R 35/04 439/18
6,750,410 B2 * 6/2004 Lee ..... C08J 9/0004 200/51 R
7,121,834 B2 * 10/2006 Gerard ..... H01R 35/04 439/21
7,125,256 B2 * 10/2006 Gerard ..... H01R 35/04 439/21
7,214,102 B2 * 5/2007 Chong ..... H01R 35/04 439/173
7,238,028 B2 * 7/2007 Gerard ..... H01R 13/652 439/188
7,255,568 B1 * 8/2007 Wu ..... B60C 19/002 439/23
7,500,854 B2 * 3/2009 Gottstein ..... H01R 25/006 439/13
7,753,682 B2 * 7/2010 Gerard ..... H01R 13/652 439/13
8,007,283 B2 * 8/2011 Gerard ..... H01R 13/652 439/13
8,011,930 B2 * 9/2011 Lee ..... H01R 13/6675 439/18
8,210,853 B2 * 7/2012 Gerard ..... H01R 13/652 439/13
8,430,679 B1 * 4/2013 Long ..... H01R 35/04 439/118
8,475,175 B2 * 7/2013 Gerard ..... H01R 13/652 439/13
8,747,119 B2 * 6/2014 Hsu ..... H01R 39/64 439/13
8,905,764 B2 * 12/2014 Cheng ..... H01R 39/64 439/24
8,920,177 B1 * 12/2014 Hsiao ..... H01R 39/00 439/13
9,419,397 B2 * 8/2016 Wu ..... H01R 39/64
9,450,365 B1 * 9/2016 Baldwin ..... H01R 35/04
9,716,362 B2 * 7/2017 Liang ..... H01R 35/04
9,728,908 B1 * 8/2017 Baldwin ..... H01R 35/04
9,905,969 B1 * 2/2018 Baldwin ..... H01R 35/04
10,033,144 B1 * 7/2018 Patterson ..... H01R 25/006
2001/0018277 A1 * 8/2001 Gerard ..... H01R 35/04 439/13
2002/0182910 A1 * 12/2002 Kiughadush ..... H01R 24/76 439/171
2006/0110946 A1 * 5/2006 Gerard ..... H01R 35/04 439/21
2006/0110947 A1 * 5/2006 Gerard ..... H01R 35/04 439/21
2006/0110948 A1 * 5/2006 Gerard ..... H01R 13/652 439/21
2008/0261430 A1 * 10/2008 Wadsworth ..... H01R 35/04 439/295

* cited by examiner

CONTINUOUSLY ROTATABLE PLUG

CROSS REFERENCE TO RELATED APPLICATIONS

This patent application is a U.S. National Phase filing of co-pending, commonly owned PCT Application No. PCT/IL17/050022, filed Jan. 8, 2017, which claims priority from U.S. Provisional Application No. 62/275,315, filed Jan. 6, 2016 both which are incorporated herein by reference in their entirety.

BACKGROUND

This disclosure is directed to a 360°, continuously rotatble (swiveling) electric plug adaptor or socket. Specifically, the disclosure is directed to a rotatble plug or socket comprising a toroidal component configured to maintain continuous, 360° conductive contact between a plugged male connector and a power source.

When an electricity-powered device needs power, a plug of the device is plugged into a wall socket, which includes slots where male prongs of the plug are inserted. Wall sockets are usually positioned at various locations and with fixed intervals on the wall, such as a bottom portion of the wall, a center portion of the wall, and the like. Most of the wall sockets are positioned at the bottom portion of the wall surface to be as unobtrusive as possible, typically hidden by furniture and the like.

Depending on the device plugged, the wire connected to the device's plug my need to be maneuvered so as not to collide with other household items, furniture and the like.

It would be an advancement to the art to enable the user to freely rotate the devices' plugs in the socket without, for example, creating kinks in the plug, or otherwise stressing the plug components. Moreover, other plugs, for example, Ethernet connectors as well as USB adaptors can also benefit from a rotating socket or plug adaptor.

SUMMARY OF THE DISCLOSURE

Disclosed, in various embodiments are rotatble plug adaptors or sockets comprising a toroidal component configured to maintain continuous, 360° conductive contact between a plugged male connector and a power source.

In an embodiment, provided herein is a rotating electrical socket or plug adaptor comprising: a housing having a front surface defining an orifice therein; a faceplate rotatably coupled to the front surface of the housing across the orifice, the faceplate defining a plurality of slots therein, configured to receive and engage a plurality of male connectors; a plurality of female connector members, each of the plurality of female connector members operably coupled to each of the plurality of slots; and a toroidal ring component having an upper planar portion, a lower planar portion, an outer rotating arc surface and an inner rotating arc surface, the upper planar portion comprising a plurality of poloidally distributed conductor tracks extending toridally on the inner rotating arc surface; the lower planar portion comprising a plurality of poloidally distributed conductor tracks extending toridally on the outer rotating arc surface, wherein each of the poloidally distributed conductor tracks extending toridally on the outer rotating arc: wherein at least one of the poloidally distributed conductor tracks extending toridally on the outer rotating arc surface is electrically slidably coupled, and wherein the each of the plurality of the female connector members is configured to electrically couple to a corresponding poloidally distributed conductor track extending toridally on the inner rotating arc surface of the toroidal ring component upon insertion of the male connector.

BRIEF DESCRIPTION OF THE FIGURES

A better understanding of the 360°, continuously rotatble electric plug adaptors or sockets provided herein, with regard to the embodiments thereof, reference is made to the accompanying drawings, in which like numerals designate corresponding elements or sections throughout and in which.

Figure 1A:
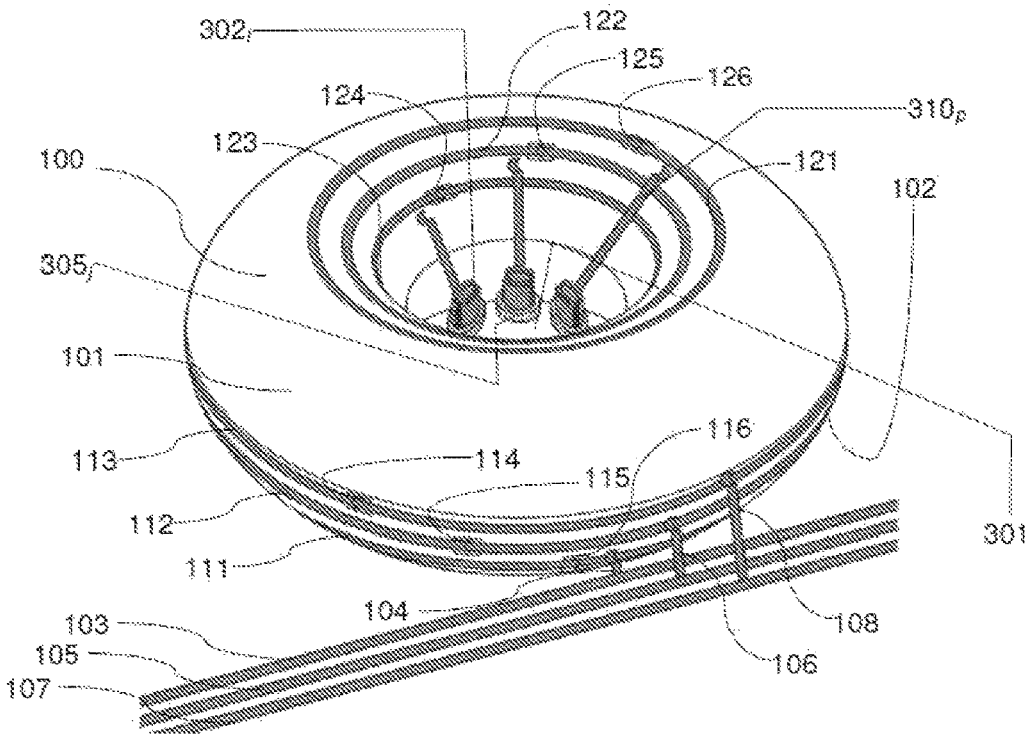
FIG. 1A, illustrates an isometric view of the toroidal component in an embodiment of the 360°, continuously rotatble electric plug adaptors or sockets in an unplugged state, with a view thereof with a plugged device male connector illustrated in FIG. 1B.

While the disclosure is amenable to various modifications and alternative forms, specifics thereof have been shown by way of example in the drawings and will be further described in detail hereinbelow. It should be understood, however, that the intention is not to limit the disclosure to the particular embodiments described. On the contrary, the intention is to cover all modifications, equivalents, and alternatives.

DETAILED DESCRIPTION

In several embodiments, provided herein are rotatble plug adaptors or sockets comprising a toroidal ring component configured to maintain continuous, 360° conductive contact between a plugged male connector and a power source. The term "toroidal ring" refers to the volume formed by a closed arc revolving around a co-planar axis wherein the radius of rotation is larger than the radius parallel with the axis of rotation, and relates generally to any annular, ring, or donut shaped body, regardless of cross-sectional geometry. The toroidal component may be solid, hollow, or otherwise hollow, but packed or filled with another material. Further, the term "toroid" is to be interpreted broader than "torus" or "ring", which both imply circumferential continuity. For example, as used herein, the term "toroid" encompasses bodies that are not only circumferentially continuous, but also bodies which contain a split, break, or open end, for example resembling a 'c' shape.

Accordingly and in an embodiment, provided herein is a rotating electrical socket or plug adaptor comprising: a housing having a front surface defining an orifice therein; a faceplate rotatably coupled to the front surface of the housing across the orifice, the faceplate defining a plurality of slots therein, configured to receive and engage a plurality of male connectors (prongs). The rotating electrical socket or plug adaptor provided and described herein can further comprise a plurality of female connector members, corresponding to the number of slots defined in the faceplate, such that each of the plurality of female connector members operably coupled to each of the plurality of slots. The female connector members can each be coupled on the internal (in other side, inside the housing) and are in communication with the slots. The slots can be parallel or slanted relative to each other, and may encompass any geometric pattern on the faceplate that is configured to engage a complementary geometric pattern on a plugged male connector (or prongs).

The rotating electrical socket or plug adaptor provided and described herein can further comprise a toroidal ring component having an upper planar portion (in other words, top half of the toroid cut horizontally), a lower planar portion (in other words, bottom half of the toroid cut horizontally), an outer rotating arc surface (referring the external surface of the toroid created by the arc defining the external half of the toroid cross section) and an inner rotating arc surface (referring the internal surface of the toroid created by the arc defining the external half of the toroid cross section). The upper planar portion can comprising a plurality of poloidally distributed conductor tracks extending toridally on the inner rotating arc surface, while the lower planar portion comprising a plurality of poloidally distributed conductor tracks extending toridally on the outer rotating arc surface, wherein each of the poloidally distributed conductor tracks extending toridally on the outer rotating arc. The term poloidal and its derivatives (e.g., poloidally distributed), refer in an embodiment to the plane (either internal or external) containing the toroid axis of rotation). The rotating electrical socket or plug adaptor provided and described herein are configured to have at least one of the poloidally distributed conductor tracks extending toridally on the outer rotating arc surface to electrically slidably couple to external power source such as the grid. In other words, as the toroid and the faceplate rotate, the poloidally distributed conductor tracks extending toridally on the outer rotating arc surface maintain continuous contact with the electric power source.

Moreover, each of the plurality of the female connector members can be configured to electrically couple to a corresponding poloidally distributed conductor track extending toridally on the inner rotating arc surface of the toroidal ring component upon insertion of the male connector, thus closing the circuit and powering the device connected with the male connector plug. Conversely, in the unplugged position, without a male connector prongs inserted in the slots and through the female connector member(s), no contact exists between the slots and the external power source, thus providing a safety element, requiring that all slots have a male connector prong inserted to close the circuit. The live conducting tracks can further be separated by a ground track, thus adding yet another safety element.

It should be noted that the same principle can be used to provide continuously rotating plug adaptors, or device sockets for Ethernet cables, telephone cables, USB plugs and connectors and similar devices where functionality depends on male/female mating to close a communication channel. Terms such as "communicate" (and its derivatives e.g., a first component "communicates with" or "is in communication with" a second component) and grammatical variations thereof are used to indicate a structural, functional, mechanical, electrical, optical, or fluidic relationship, or any combination thereof, between two or more components or elements. As such, the fact that one component is said to communicate with a second component is not intended to exclude the possibility that additional components can be comprised between, and/or operatively associated or engaged with, the first and second components. Further, the term "slidably coupled" or derivatives thereof refers to a state in which two or more components are coupled to one another in which at least one of the components at least slides with respect to another component. The terms "slide", "slid", or "sliding" are defined as moving, gliding or passing along a surface, although continuous contact is not necessarily required.

A more complete understanding of the components, processes, assemblies and devices disclosed herein can be obtained by reference to the accompanying drawings. These figures (also referred to herein as "FIG.") are merely schematic representations based on convenience and the ease of demonstrating the comprised disclosure, and are, therefore, not intended to indicate relative size and dimensions of the devices or components thereof and/or to define or limit the scope of the exemplary embodiments. Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

Figure 1B:
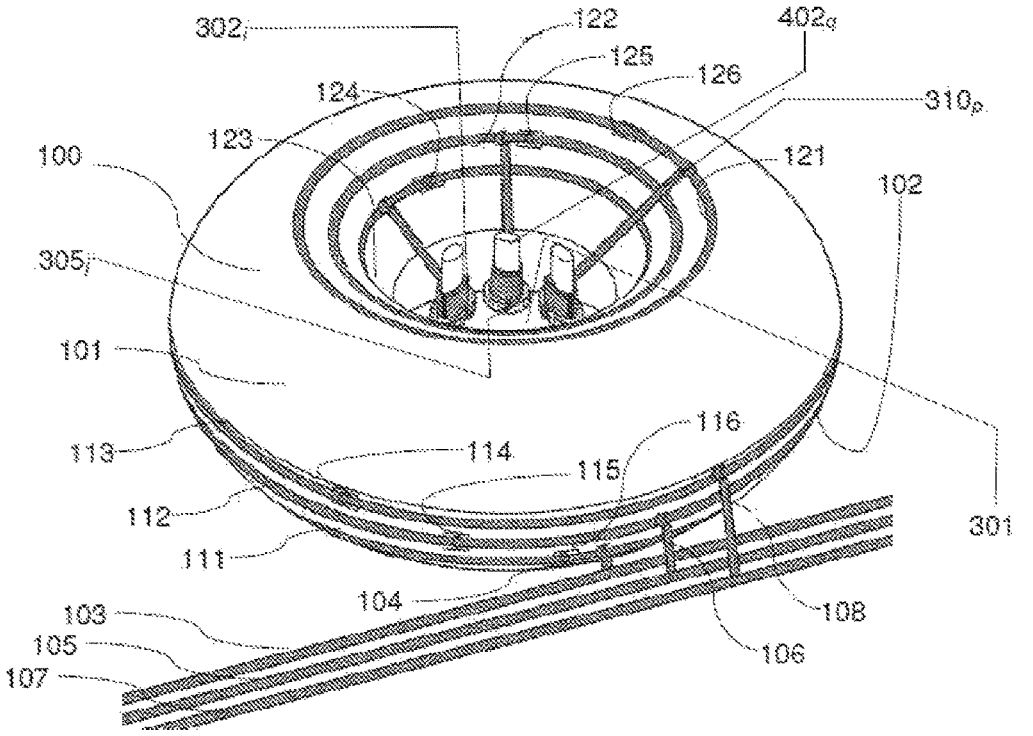

Turning now to FIGS. 1A-7B, illustrating in FIG. 1A, isometric view of the toroidal component in the 360°, continuously rotatble electric plug adaptors or sockets described, shown in an unplugged state (in other words, no male connector prongs inserted), with a view thereof with a plugged device's male connector prongs illustrated in FIG. 1B.

As illustrated, and together with FIGS. 2-4B, provided is rotating electrical socket or plug adaptor 10 comprising: housing 300 having front surface 340 (see e.g., FIG. 4B) defining orifice (or window) $\mathbf{330}_m$ therein. Housing 300 can further comprise faceplate 301 rotatably coupled to front surface 340 of housing 300 across orifice $\mathbf{330}_m$. Housing 300 may define more than a single m orifice 330m (see e.g., FIG. 4B). Likewise, m orifice 330*m* need not be necessarily round and can have any shape (quadrilateral, triangular and the like). Faceplate 301 can define plurality of slots $\mathbf{320}_n$ therein, each $n^{th}$ slot $\mathbf{320}_n$ configured to receive and engage plurality of male connectors' 400 prongs $\mathbf{402}_q$. As described, slots $\mathbf{320}_n$ can be parallel or slanted relative to each other, and encompass any geometric pattern on faceplate 301 that is configured to receive and engage a complementary geometric pattern on plugged male connector 400 prongs $\mathbf{402}_q$.

Figure 2:
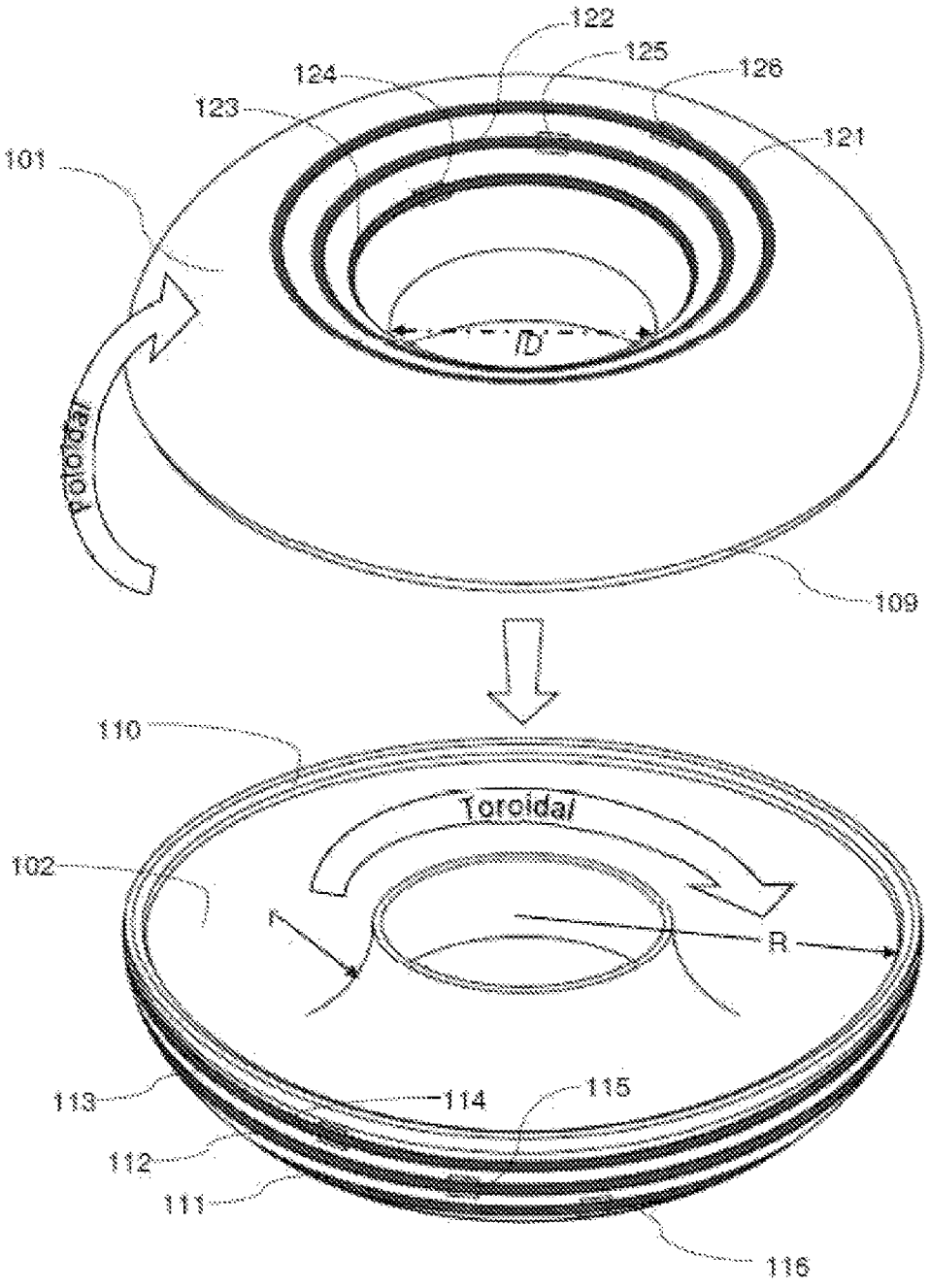
FIG. 2 illustrates an exploded top left isometric view of the toroidal component in an embodiment of the 360°, continuously rotatble electric plug adaptors or sockets.

Housing 300 can further comprise plurality of female connector members $\mathbf{500}_v$ (see e.g., FIG. 5A) each $v^{th}$ of plurality of female connector members $\mathbf{500}_v$ being operably coupled to each $n^{th}$ of plurality of slots $\mathbf{320}_n$ (see e.g., FIGS. 1A, 1B). As illustrated in FIG. 1A-2, housing 300 can further comprise toroidal ring component 100 having upper planar portion 101, lower planar portion 102, an outer rotating arc surface and an inner rotating arc surface (not shown). Upper planar portion 101 can comprise plurality of poloidally distributed conductor tracks (121, 122, 123) extending toridally on the inner rotating arc surface (not shown), and lower planar portion 102 of toroidal ring component 100 can comprise plurality of poloidally distributed conductor tracks (111, 112, 113) extending toridally on the outer rotating arc surface (not shown), wherein at least one of the poloidally distributed conductor tracks (111, 112, 113) extending toridally on the outer rotating arc surface (not shown) is electrically slidably coupled (in other words, to a power source), and wherein each $v^{th}$ of the plurality of female connector members $\mathbf{500}_v$ can be configured to electrically couple to a corresponding poloidally distributed conductor track (121, 122, 123) extending toridally on the inner rotating arc surface (not shown) of toroidal ring component 100 upon insertion of male connector 401 prong $\mathbf{402}_q$.

Figure 4A:
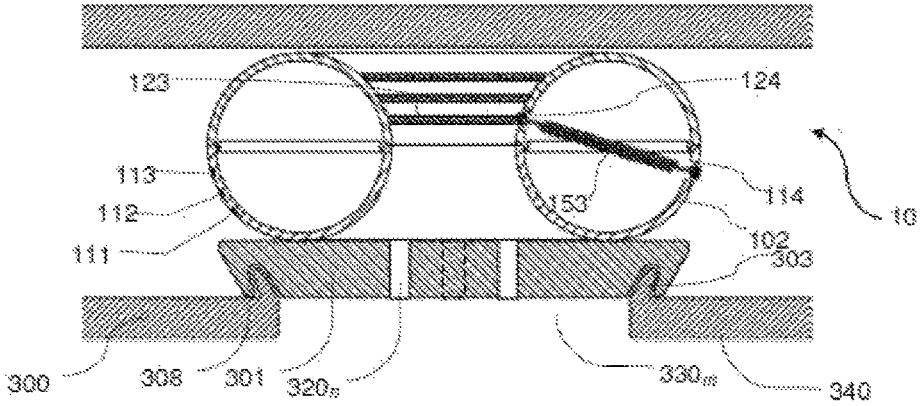
FIG. 4A illustrates a X-Z cross section of the toroidal component in a portion of the housing of the 360°, continuously rotatble electric plug adaptors or sockets with a bottom isometric view of an embodiment including three such rotating sockets or plug adaptors in FIG. 4B.
Figure 4B:
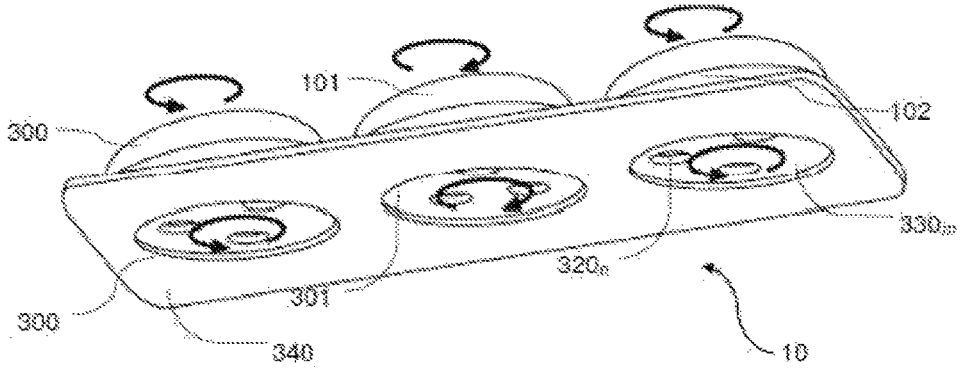

As illustrated in FIG. 4A, orifice $\mathbf{330}_m$ defined in front surface 340, comprised in the sockets and/or plug adaptors described herein, can further comprise a rearward (in other words, rising away from front surface 340) extending circular ring 303. Ring 303 can be configured to create rotating track that can be configured to be received and engaged in a corresponding circular channel 308 defined generally on the periphery of faceplate 301. Circular channel 308 can be configured then, to rotatbly couple to rearward extending ring (or circular track) 303. It is noted that in those circumstances whereby orifice (or window) $\mathbf{330}_m$ is not circular, but any other polygonal shape, the polygonal shape defining orifice $\mathbf{330}_m$ can be subsumed in rearward extending ring 303.

As illustrated in FIG. 2, toroidal ring component 100 comprised in the sockets and/or plug adaptors described herein, can be hollow and have upper planar portion 101, lower planar portion 102. To reduce the depth of housing 300, toroidal ring component 100 can have volume defined by an oblate spheroid rotating about an axis coplanar with the oblate spheroid's minor axis.

As further illustrated in FIG. 2, upper planar portion 101 can comprise plurality of poloidally distributed (longitudinally from pole to pole) conductor tracks (121, 122, 123) extending toridally (in other words in latitude) on the inner rotating surface (defined by the internal pole-to-pole) arc (not shown). Conversely, lower planar portion 102 of toroidal ring component 100 can comprise plurality of poloidally distributed conductor tracks (111, 112, 113) extending toridally on the outer rotating arc surface (not shown), wherein the poloidally distributed conductor tracks (111, 112, 113) extending toridally on the outer rotating arc surface (not shown) can be electrically slidably coupled (in other words, to a power source or portions (minus/plus/ground). Inner diameter ID (equal to $2\cdot(R-2r)$) of the toroidal ring component 100, wherein R is the outer diameter of toroidal ring component 100 and r is equal to the major radius of the rotating closed arc (if not a circle and r of the circle), defining toroidal ring component 100, and can be configured to be equal to or smaller than rearward extending ring 303 such that each $v^{th}$ of the plurality of female connector members $\mathbf{500}_v$ can be configured to electrically couple to a corresponding poloidally distributed conductor track (121, 122, 123) extending toridally on the inner rotating arc surface (not shown) of toroidal ring component 100 upon insertion of male connector 401 (see e.g., FIG. 6B) prong $\mathbf{402}_q$.

Figure 5A:
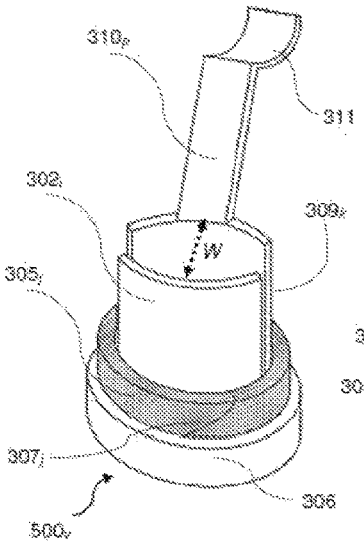
FIG. 5A, illustrates a top isometric view of an unplugged first embodiment of the female connector member, with a front elevation view thereof in FIG. 5B, and a right side elevation view thereof in FIG. 5C.
Figure 5B:
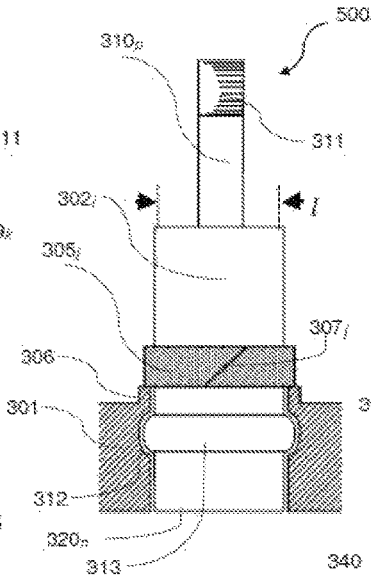
Figure 5C:
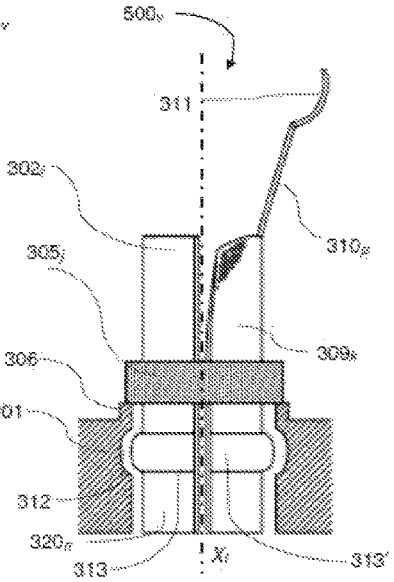

Turning now to FIGS. 5A-7B, illustrating embodiments of female connector members $\mathbf{500}_v$. As illustrated, each $v^{th}$ connector of female connector member $\mathbf{500}_v$ comprised in sockets and/or plug adaptors 10 described herein, can comprise front arcuate elongated slab $\mathbf{302}_i$ having an outer frontal convex surface (in other words toward the center of upper planar portion 101 of toroidal ring component 100), with transverse shelf 313 disposed basally and rear arcuate elongated slab $\mathbf{309}_k$ having an outer posterior convex surface (in other words toward the periphery of upper planar portion 101 of toroidal ring component 100) with transverse shelf 313' disposed basally. Alternatively or in addition (e.g., in another $v^{th}$ female connector member $\mathbf{500}_v$ either in the same and/or another $m^{th}$ orifice $\mathbf{330}_m$, arcuate elongated slab 302*i*, or arcuate elongated $\mathbf{309}_k$, can be a single element with an open arc defining a substantially ovoid cross section (e.g., generally C-shaped). It is understood, that arcuate elongated slab 302*i*, and/or arcuate elongated $\mathbf{309}_k$, can be fabricated from a resilient conductive material. As illustrated in FIG. 5A, front arcuate elongated slab $\mathbf{302}_i$ having an outer frontal convex surface and rear arcuate elongated slab $\mathbf{309}_k$ having an outer posterior convex surface form substantially ovoid cross section having a major axis and minor axis w, (see e.g., FIG. 5A), configured to be smaller than the width Wt of male connector 401 prong $\mathbf{402}_q$ (see e.g., FIG. 6A). The term "C-shaped" refers to any single structure that terminates in two prongs or legs the majority of which extend in a same general direction. Transition between such prongs or legs may be curved, or more of a acute right angle.

In addition, each $v^{th}$ connector of female connector member $\mathbf{500}_v$ comprised in sockets and/or plug adaptors 10 described herein, can comprise biasing member $\mathbf{305}_j$, disposed over collar 306 (see e.g., FIG. 7A), configured to bias front arcuate elongated slab $\mathbf{302}_i$ towards rear arcuate elongated slab $\mathbf{309}_k$. Additionally or alternatively, when arcuate elongated slab 302*i*, or arcuate elongated $\mathbf{309}_k$, is a single element with an open arc defining a substantially ovoid cross section (e.g., generally C-shaped; construed to include a variety of concave shapes which would similarly enhance the functionality of elongated slab(s) $\mathbf{302}_i$ and/or $\mathbf{309}_k$), biasing element $\mathbf{305}_j$ can be configured to bias the prongs or 'legs' of the structure toward each other, urging the gap to close. The term "biasing element" refers to any device that provides a biasing force. Representative biasing elements include but are not limited to springs (e.g., elastomeric or metal springs, torsion springs, coil springs, leaf springs, tension springs, compression springs, extension springs, spiral springs, volute springs, flat springs, and the like), detents (e.g., spring-loaded detent balls, cones, wedges, cylinders, and the like), pneumatic devices, hydraulic devices, magnets, and the like, and combinations thereof. Likewise; "biasing member", as used herein, refers in an embodiment to one or more members that applies an urging force between two elements or between two portions of the same element. Moreover, the term C-shaped refers to any single structure that terminates in two prongs or legs the majority of which extend in a same general direction. Transition between such prongs or legs may be curved, such as shown, or more of a acute right angle. It is understood, that by using e.g., resilient conductive metals, when arcuate elongated slab 302*i*, and/or arcuate elongated $\mathbf{309}_k$, is a single element, such element can be self-biasing.

In an embodiment, biasing element $\mathbf{305}_j$ can be a biasing ring, which surrounds rear arcuate elongated slab $\mathbf{302}_i$, and/or arcuate elongated $\mathbf{309}_k$, and bears against it with radial pre-stress. As illustrated e.g., in FIGS. 6B and 7B, biasing element $\mathbf{305}_j$ can open against gap $\mathbf{307}_j$.

Also, as illustrated in FIGS. 5A-7B, each $v^{th}$ connector of female connector member $\mathbf{500}_v$ comprised in sockets and/or plug adaptors 10 described herein, can comprise resilient contact rod $\mathbf{310}_p$ extending apically in a posterior direction (in other words toward the periphery of upper planar portion 101 of toroidal ring component 100) from rear arcuate elongated slab $309_k$, or from the posterior prong or leg when arcuate elongated slab 302*i*, or arcuate elongated $309_k$, is a single element. As illustrated in FIGS. 5A-7B, resilient contact rod $310_p$ comprised in each $v^{th}$ connector of female connector member $500_v$ of the sockets and/or plug adaptors 10 described herein, can further comprises arcuate tab 311 extending apically from the contact rod.

Figure 7A:
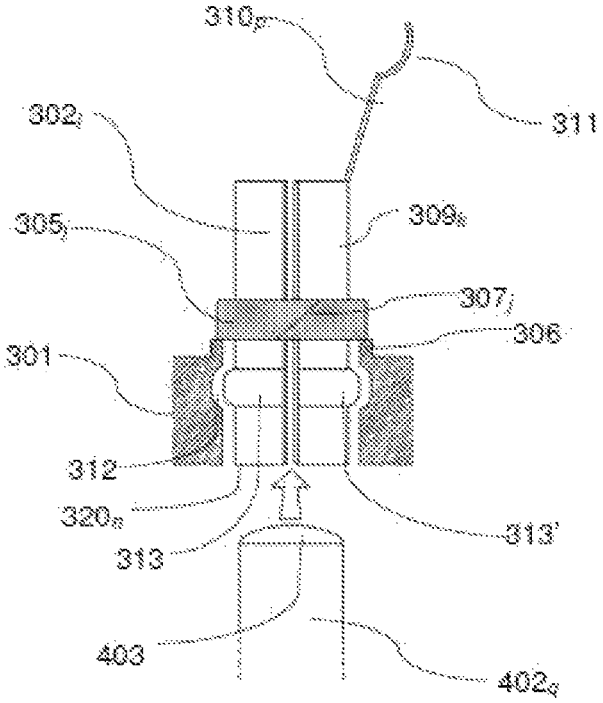
FIG. 7A, illustrates a side elevation view of the first unplugged embodiment of the female connector member, with a plugged side elevation view thereof in FIG. 7B.

As illustrated in e.g., FIG. 7A, faceplate 301 defines a radial groove 312 in $n^{th}$ slot 320*n* configured to accommodate and engage transverse shelf 313, basally disposed in the front arcuate elongated slab $302_i$ and transverse shelf 313' basally disposed in rear arcuate elongated slab $309_k$, and wherein the distance between the axial center of front arcuate elongated slab 302*i* and the axial center of rear arcuate elongated slab $309_k$, w (see e.g., FIG. 5A) is smaller than the width of male connector 401 prong $402_q$. It is noted, that when, in certain embodiments; male connector 401 prong 402*q* is a cylindrical peg, w is smaller than the diameter of the peg.

As illustrated in FIGS. 6A-7B, male connector 401 used in the device plugs can comprise elongated slab 402*q* or another generally elongated shape with other cross section, having arcuate tip 403, elongated slab (or other elongated prong member) can be configured to extend beyond the apical end of front arcuate elongated slab $302_i$ of the $v^{th}$ female connector member $500_v$ and beyond the apical end of the rear arcuate elongated slab 309hd k.

Figure 6A:
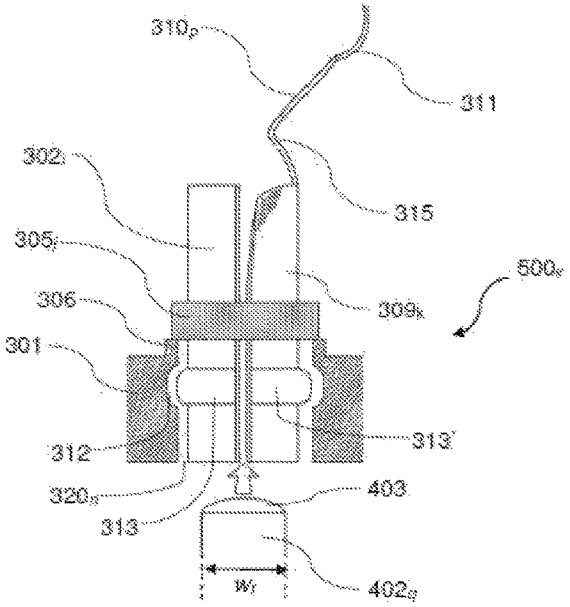
FIG. 6A, illustrates a side elevation view of a second unplugged embodiment of the female connector member, with a plugged side elevation view thereof in FIG. 6B.
Figure 6B:
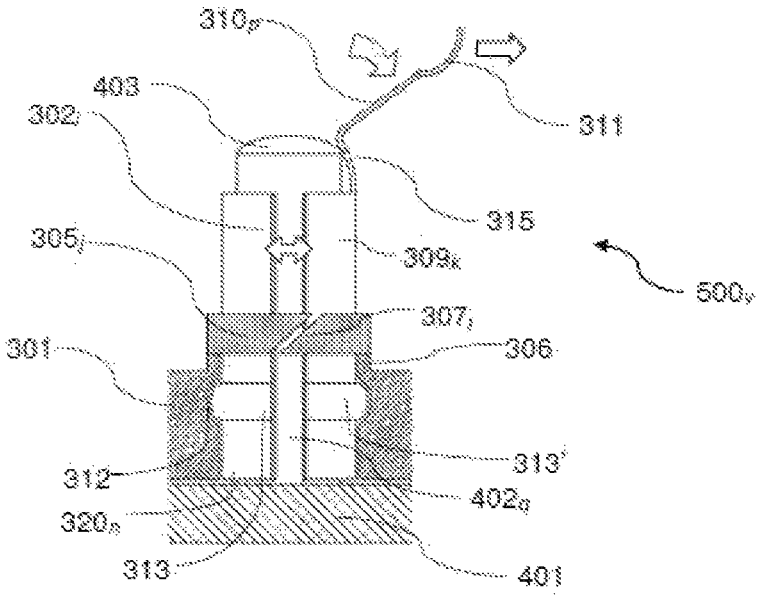
Figure 7B:
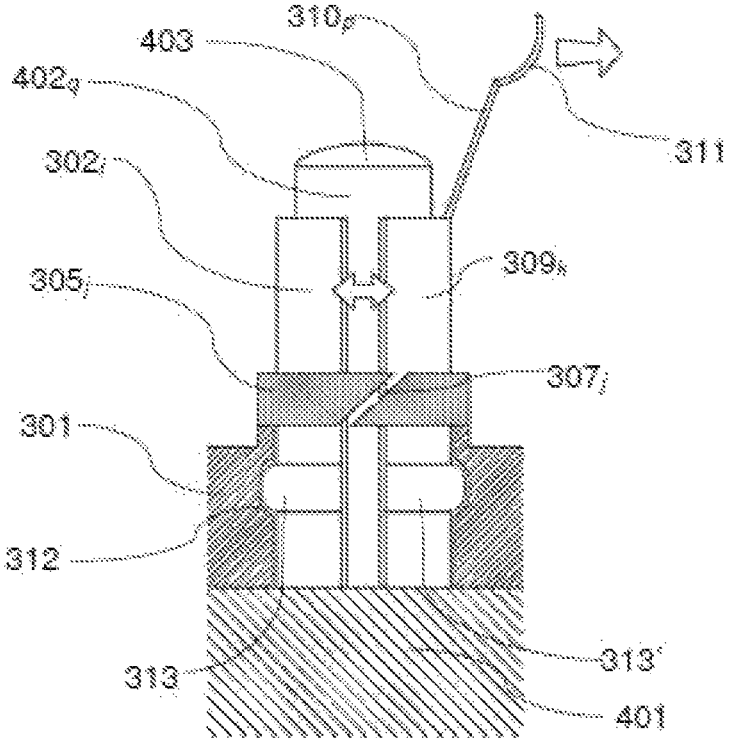

As illustrated in FIGS. 1B, 6B and 7B, resilient contact rod $310_p$ comprised in each $v^{th}$ connector of female connector member $500_v$ of the sockets and/or plug adaptors 10 described herein, can be configured to abut or operably couple to a corresponding poloidally (see e.g., FIG. 2) distributed conductor track (e.g., 121, 122, 123 FIG. 1B), extending toridally on the inner rotating arc surface of toroidal ring component 100 upon insertion of the male connector 401 prong $402_q$. The term "abut" refers to components or parts that are in direct physical contact with each other, although the items may not be attached, secured, fused, or welded together.

Turning now to FIGS. 6A, 6B, resilient contact rod $310_p$ comprised in each $v^{th}$ connector of female connector member $500_v$ of the sockets and/or plug adaptors 10 described herein, can further comprise elbow 315 extending forward (in other words above and toward front arcuate elongated slab $302_i$, from rear arcuate elongated slab $309_k$. As illustrated in FIG. 6B, insertion of arcuate tip 403 of male connector 401 prong $402_q$ abutting elbow 315 will articulate resilient contact rod $310_p$ rearwards, causing arcuate tab 311 to translate toward the periphery of upper planar portion 101 of toroidal ring component 100 and operably couple or abut a corresponding poloidally distributed conductor track (121, 122, 123) extending toridally on the inner rotating arc surface (not shown) of toroidal ring component 100.

Similarly and as shown in FIGS. 7A, 7B and 1B, insertion of arcuate tip 403 of male connector 401 prong $402_q$ when the distance between the axial center of front arcuate elongated slab $302_i$ and the axial center of rear arcuate elongated slab $309_k$, w (see e.g., FIG. 5A) is smaller than the width of male connector 401 prong $402_q$ (or the diameter normal to the major axis of the ovoid cross section defined by front arcuate elongated slab $302_i$ and the axial center of rear arcuate elongated slab $309_k$), will bias either front arcuate elongated slab $302_i$ from the axial center of rear arcuate elongated slab $309_k$, or separate the legs or prongs when arcuate elongated slab 302*i*, and/or arcuate elongated $309_k$, is a single C-shaped element. Biasing either front arcuate elongated slab $302_i$, away from the axial center of rear arcuate elongated slab $309_k$, or separating the legs or prongs when arcuate elongated slab $302_i$, and/or arcuate elongated $309_k$, is a single C-shaped element would cause resilient contact rod $310_p$ to translate rearwards, causing arcuate tab 311 to advance toward the periphery of upper planar portion 101 of toroidal ring component 100 and operably couple or abut corresponding poloidally distributed conductor track (121, 122, 123) extending toridally on the inner rotating arc surface (not shown) of toroidal ring component 100.

Figure 3:
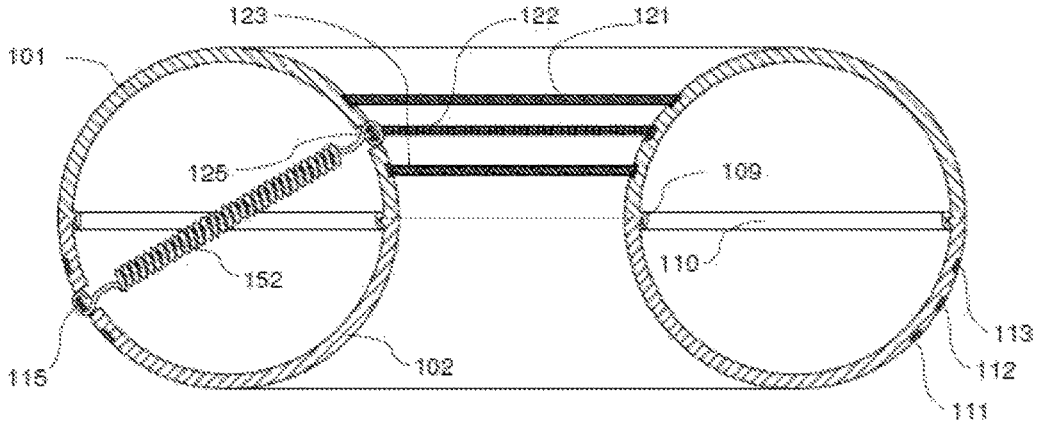
FIG. 3, illustrates a X-Z cross section of the toroidal component in an embodiment of the 360°, continuously rotatble electric plug adaptors or sockets.

Turning now to FIGS. 3 and 4, illustrating toroidal ring component 100 having upper planar portion 101, lower planar portion 102, an outer rotating arc surface and an inner rotating arc surface, whereby upper planar portion 101 comprising three poloidally distributed conductor tracks 121, 122, 123, extending toridally on the inner rotating arc surface. As described, lower planar portion 102 comprising three poloidally distributed conductor tracks 111, 112, 113 extending toridally on the outer rotating arc surface. As illustrated in FIGS. 3, 4A, of the three poloidally distributed conductor tracks 111, 112, 113 extending toridally on the outer rotating arc surface is in electric communication with a diametrically opposed poloidally distributed conductive track 121, 122, 123 extending toridally on the inner rotating arc surface. As illustrated (see e.g., FIGS. 2-4A), the three poloidally distributed conductor tracks 111, 112, 113 extending toridally on the outer rotating arc surface can maintain contact with the diametrically opposed poloidally distributed conductive track 121, 122, 123 extending toridally on the inner rotating arc surface, using for example coupler 152 to couple middle conducting track 112 extending toridally on the outer rotating arc surface, with conducting track 122 extending toridally on the inner rotating arc surface through corresponding gap 115 disposed at the same latitude as middle conducting track 112 extending toridally on the outer rotating arc surface, terminating at gap 125 disposed at the same latitude as middle conducting track 122 extending toridally on the inner rotating arc surface (see e.g., FIG. 3).

As illustrated in FIG. 4A, similarly, coupler 153 can be used to couple top conducting track 113 extending toridally on the outer rotating arc surface, with diametrically opposed bottom conducting track 123 extending toridally on the inner rotating arc surface through corresponding gap 114 disposed at the same latitude as top conducting track 113 extending toridally on the outer rotating arc surface, terminating at gap 124 disposed at the same latitude as bottom conducting track 123 extending toridally on the inner rotating arc surface. Gaps 114, 115, 116 location on the outer rotating arc surface are poloidaly aligned (in other words, on respectively the same longitude with gaps 124, 125, 126 on the inner rotating arc surface. Gaps locations illustrated in FIGS. 1A, 1B, and 2 are for illustration only and should not be viewed as rigid indicators of the gaps location.

Moreover, although couplers 152, 153 are illustrated as a conductive spring in an embodiment, other coupling means are also contemplated, which can be, for example welded tracks, pins or other appropriate coupling means enabling electric communication (and conducting contact) between the three poloidally distributed conductor tracks 111, 112, 113 extending toridally on the outer rotating arc surface and their diametrically opposed poloidally distributed conductive track 121, 122, 123 extending toridally on the inner rotating arc surface.

In an embodiment, the term "engage" and various forms thereof, when used with reference to coupling of various components and engaging elements therein, refer to the application of any forces that tend to hold the engaged components together against inadvertent or undesired separating forces (e.g., such as may be introduced during use of an engaged component). It is to be understood, however, that engagement does not, in all cases require an interlocking connection that is maintained against every conceivable type or magnitude of separating force. Moreover, "engaging element" refers to one or a plurality of coupled components, at least one of which is configured for releasably engaging an engaged element, member or portion thereof. Thus, this term encompasses both single part engaging elements and multi-part-assemblies.

The term "resilient" (elastically flexible) is used to qualify such flexible features e.g., for resilient contact rod $\mathbf{310}_p$, as generally returning to the initially molded shape without permanent deformation.

The term "coupled", including its various forms such as "operably coupling", "coupling" or "couplable", refers to and comprises any direct or indirect, structural coupling, connection or attachment, or adaptation or capability for such a direct or indirect structural or operational coupling, connection or attachment, including integrally formed components and components which are coupled via or through another component or by the forming process. Indirect coupling may involve coupling through an intermediary member or adhesive, or abutting and otherwise resting against, whether frictionally or by separate means without any physical connection.

"Combination" is inclusive of blends, mixtures, alloys, reaction products, and the like. Furthermore, the terms "first," "second," and the like, herein do not denote any order, quantity, or importance, but rather are used to denote one element from another.

The terms "a", "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the prong(s) includes one or more prong).

Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be comprised in other embodiments. In addition, it is to be understood that the described elements may be combined in any suitable manner in the various embodiments.

The term "about", when used in the description of the technology and/or claims means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such and may include the end points of any range provided including, for example ±25%, or ±20%, specifically, ±15%, or ±10%, more specifically, ±5% of the indicated value of the disclosed amounts, sizes, formulations, parameters, and other quantities and characteristics.

One or more components may be referred to herein as "configured to," "configured by," "configurable to," "operable/operative to," "adapted/adaptable," "able to," "conformable/conformed to," etc. The terms (e.g. "configured to") can generally encompass active-state components and/or inactive-state components and/or standby-state components, unless context requires otherwise.

Furthermore, for the purposes of the comprised disclosure, directional or positional terms such as "top", "bottom", "upper," "lower," "side," "front," "frontal," "forward," "rear," "rearward," "back," "trailing," "above," "below," "left," "right," "horizontal," "vertical," "upward," "downward," "outer," "inner," "exterior," "interior," "intermediate," "posterior", "anterior", "apically", "basally" etc., are merely used for convenience in describing the various embodiments of the comprised invention.

While particular embodiments of the 360°, continuously rotatble (swiveling) electric plug adaptor or socket; more specifically, embodiments relating to rotatble plug adaptors or sockets comprising a toroidal component described, alternatives, modifications, variations, improvements, and substantial equivalents that are or may be presently unforeseen may arise to applicants or others skilled in the art. Accordingly, the appended claims as filed and as they may be amended, are intended to embrace all such alternatives, modifications variations, improvements, and substantial equivalents.

The invention claimed is:

1. A rotating electrical socket or plug adaptor comprising:

a. a housing having a front surface defining an orifice therein;

b. a faceplate rotatably coupled to the front surface of the housing across the orifice, the faceplate defining a plurality of slots therein, configured to receive and engage a plurality of male connector prongs;

c. a plurality of female connector members, each of the plurality of female connector members operably coupled to each of the plurality of slots; and d. a toroidal ring component having an upper planar portion, a lower planar portion, an outer rotating arc surface and an inner rotating arc surface, i. the upper planar portion comprising a plurality of poloidally distributed conductor tracks extending toridally on the inner rotating arc surface;

ii. the lower planar portion comprising a plurality of poloidally distributed conductor tracks extending toridally on the outer rotating arc surface, wherein each of the poloidally distributed conductor tracks extending toridally on the outer rotating arc:

wherein at least one of the poloidally distributed conductor tracks extending toridally on the outer rotating arc surface is electrically slidably coupled, and wherein the each of the plurality of the female connector members is configured to electrically couple to a corresponding poloidally distributed conductor track extending toridally on the inner rotating arc surface of the toroidal ring component upon insertion of the male connector prong.

2. The socket of clam 1, wherein the orifice defined in the front surface further comprises a rearward extending circular ring and wherein the faceplate further defines a circular channel configured to rotatbly couple to the rearward extending ring.

3. The socket of claim 1, wherein each of the female connector member comprises:

a. a front arcuate elongated slab having an outer frontal convex surface with a transverse shelf disposed basally;

b. a rear arcuate elongated slab having an outer posterior convex surface with a transverse shelf disposed basally;

c. a biasing member configured to bias the front arcuate elongated slab towards the rear arcuate elongated slab; and d. a resilient contact rod extending apically from the rear arcuate elongated slab, wherein the faceplate defines a front arcuate groove configured to accommodate and engage the transverse shelf basally disposed in the front arcuate elongated slab and a posterior arcuate groove configured to accommodate and engage the transverse shelf basally disposed in the rear arcuate elongated slab, and wherein the distance between the axial center of the front arcuate elongated slab and the axial center of the is smaller than the width of the male connector prong.

4. The socket of claim 3, wherein the male connector comprises an elongated prong slab having an arcuate tip, the elongated prong slab configured to extend beyond the apical end of the front arcuate elongated slab of the female connector and beyond the apical end of the rear arcuate elongated slab of the female connector.

5. The socket of claim 4, wherein the resilient contact rod is configured to abut a corresponding poloidally distributed conductor track extending toridally on the inner rotating arc surface of the toroidal ring component upon insertion of the male connector.

6. The socket of claim 5, wherein the resilient contact rod further comprises an arcuate tab extending apically from the contact rod.

7. The socket of claim 6, wherein the resilient contact rod further comprises an elbow extending forward from the rear arcuate elongated slab and wherein the arcuate tip of the male connector is configured to abut the elbow.

8. The socket of claim 7, wherein the male connector prong, front arcuate elongated of the female connector member, arcuate elongated of the female connector member, and the contact rod are each made of conductive material.

9. The socket of claim 1, wherein toroidal ring component having an upper planar portion, a lower planar portion, an outer rotating arc surface and an inner rotating arc surface, a. the upper planar portion comprising three poloidally distributed conductor tracks extending toridally on the inner rotating arc surface; and b. the lower planar portion comprising three poloidally distributed conductor tracks extending toridally on the outer rotating arc surface, wherein each of the three poloidally distributed conductor tracks extending toridally on the outer rotating arc surface is in electric communication with a diametrically opposing poloidally distributed conductive track extending toridally on the inner rotating arc surface.

10. The socket of claim 1, wherein the toroidal ring component is defined by an oblate spheroid rotating about an axis coplanar with the oblate spheroid's minor axis.

* * * * *